US008336438B2

(12) United States Patent
Compton et al.

(10) Patent No.: US 8,336,438 B2
(45) Date of Patent: Dec. 25, 2012

(54) ELECTRO-MECHANICAL FIREARM TRIGGER MECHANISM

(75) Inventors: David Walter Compton, Kitchener (CA); Brenton Stewart Teed, Kitchener (CA)

(73) Assignee: Colt Canada Corporation (CA)

( * ) Notice: Subject to any disclaimer, the term of this patent is extended or adjusted under 35 U.S.C. 154(b) by 212 days.

(21) Appl. No.: 12/767,366

(22) Filed: Apr. 26, 2010

(65) Prior Publication Data

US 2011/0259183 A1 Oct. 27, 2011

(51) Int. Cl.
*F41A 19/59* (2006.01)

(52) U.S. Cl. ..... 89/28.1; 89/132; 89/135; 89/136; 89/148

(58) Field of Classification Search ..... 42/84; 89/28.1, 89/132, 135, 136, 142, 144, 148, 149
See application file for complete search history.

(56) References Cited

U.S. PATENT DOCUMENTS

| | | | | |
|---|---|---|---|---|
| 2,780,882 | A | 2/1957 | Temple | |
| 3,045,555 | A | 7/1962 | Stoner | |
| 3,075,433 | A * | 1/1963 | Stockholm | 89/13.05 |
| 3,703,845 | A | 11/1972 | Griew | |
| 4,196,653 | A * | 4/1980 | Jackson | 89/136 |
| 4,433,610 | A | 2/1984 | Tatro | |
| 4,510,844 | A | 4/1985 | Fritz et al. | |
| 4,718,187 | A * | 1/1988 | Blake | 42/84 |
| 4,727,670 | A | 3/1988 | Krouse | |
| 4,793,085 | A | 12/1988 | Surawski et al. | |
| 5,083,392 | A | 1/1992 | Bookstaber | |
| 5,251,533 | A | 10/1993 | Layton | |
| 5,485,776 | A | 1/1996 | Ealovega | |
| 5,713,150 | A | 2/1998 | Ealovega | |
| 5,760,328 | A | 6/1998 | Robbins | |
| 6,176,169 | B1 * | 1/2001 | Rostocil | 89/28.05 |
| 6,976,416 | B2 | 12/2005 | Ealovega | |
| 7,073,284 | B2 | 7/2006 | Monks et al. | |
| 7,131,228 | B2 | 11/2006 | Hochstrate et al. | |
| 2010/0224056 | A1 * | 9/2010 | Monroe | 89/193 |
| 2011/0173865 | A1 * | 7/2011 | Compton et al. | 42/84 |

* cited by examiner

*Primary Examiner* — Michael David
(74) *Attorney, Agent, or Firm* — Cantor Colburn LLP

(57) ABSTRACT

An electro-mechanical firearm trigger mechanism for controlling the rate of fire for a firearm in automatic firing mode. The controlling being achieved through the use of a solenoid directed by a computer processor. The computer processor being connected to multiple sensors to instruct the solenoid on a rate of fire or to disengage automatic fire if needed.

21 Claims, 2 Drawing Sheets

ELECTRO-MECHANICAL FIREARM TRIGGER MECHANISM

FIELD OF THE INVENTION

Embodiments of the invention relate generally to firearms. More particularly, embodiments of the invention relate to an electro-mechanical trigger mechanism for an automatic firearm.

BACKGROUND OF THE INVENTION

It is known that firearms that have purely mechanical automatic trigger mechanisms, such as the type disclosed in U.S. Pat. No. 3,045,555 to Stoner, can operate with excessively high firing rates in an automatic firing mode. M16 type firearms using purely mechanical automatic trigger mechanisms can have rates of fire well in excess of 600 rounds per minute, particularly in models with shorter barrels. These high rates of fire may be problematic, as they can, among other things, affect the control and accuracy of the firearm, increase the accumulation of heat in the barrel, or result in unnecessary wastage of ammunition.

High rates of fire affect the control and accuracy of the firearm due to muzzle climb, as there is insufficient time between consecutive discharges to allow the operator to return the firearm to its original point of aim. This is compounded by a desire to increase the portability and maneuverability of firearms by reducing weight and size, which respectively contribute to decreased stability and further increased rates of fire.

In addition, the accumulation of heat in the barrel may contribute to erosion and wear in the barrel, and can further impact the accuracy of the firearm.

It is, therefore, desirable to provide an electro-mechanical trigger mechanism for an automatic firearm to provide a controlled rate of fire when the firearm is operated in an automatic firing mode.

SUMMARY OF THE INVENTION

In a first aspect, there is provided an electro-mechanical trigger mechanism for controlling automatic firing of a firearm, the electro mechanical trigger mechanism comprising a solenoid operatively connected to a sear disconnect of the firearm; and a processor, for controlling the solenoid; wherein, based on inputs to the processor, the processor controls a flow of current to the solenoid to control the automatic firing of the firearm.

In a further aspect, there is provided a method of controlling an automatic firing mode for a firearm by controlling a rate of fire using an electro-mechanical trigger mechanism comprising determining that the firearm is in the automatic firing mode; and supplying a flow of current to a solenoid to control the rate of fire via a sear disconnect connected to the solenoid.

Other aspects and features of embodiments will become apparent to those ordinarily skilled in the art upon review of the following description of specific embodiments of the invention in conjunction with the accompanying figures.

BRIEF DESCRIPTION OF THE DRAWINGS

Embodiments of the invention will now be described, by way of example only, with reference to the attached Figures, wherein.

DETAILED DESCRIPTION

In this disclosure, an embodiment of an electro-mechanical trigger mechanism and a method for using such a mechanism to control a firearm are disclosed. Embodiments of the invention may be applied to a wide variety of firearms, but is shown here in an embodiment with an automatic firearm, such as an AR-15, M16 or U.S. Pat. No. 3,045,555 (Stoner) type.

Figure 1:
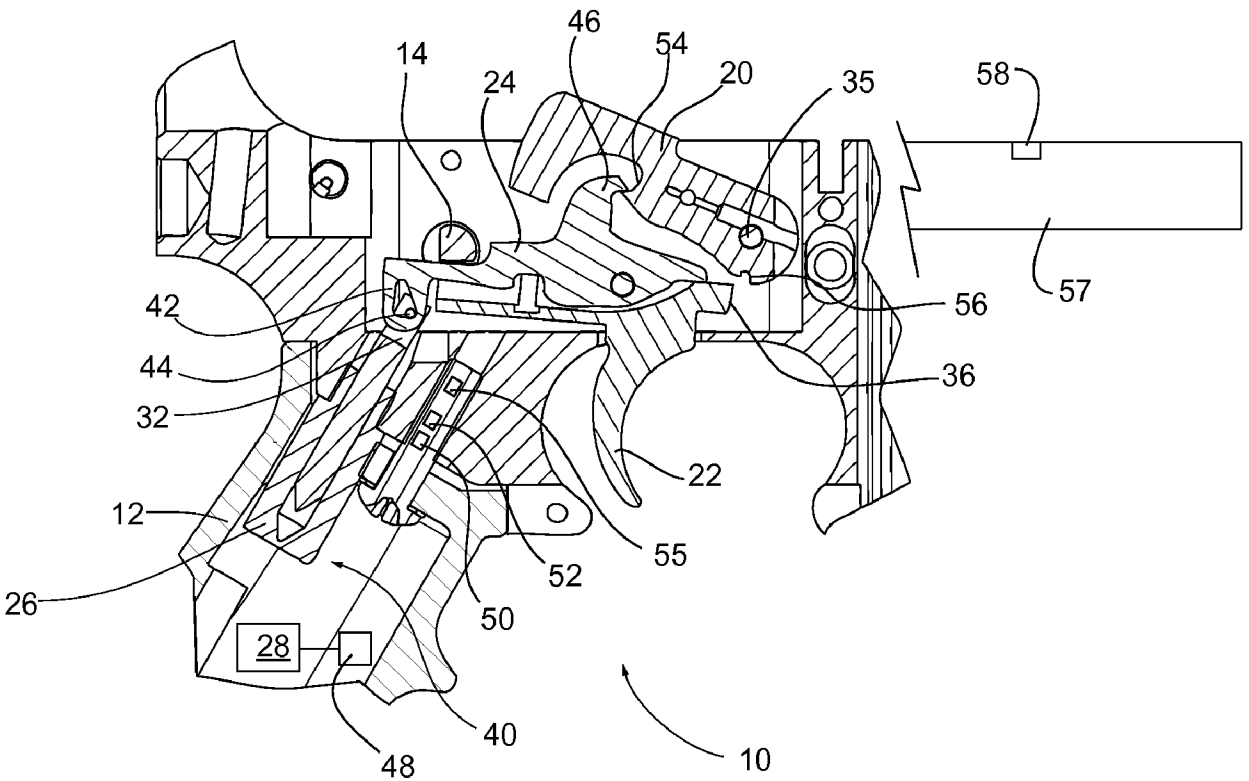
FIG. 1 is a cross-sectional view of a portion of a firearm incorporating an electro-mechanical trigger mechanism.

FIG. 1 shows a first cross sectional view of a firearm 10 incorporating an electro-mechanical trigger mechanism. In one embodiment the electro-mechanical trigger mechanism 40 resides within a hand grip 12.

The electro-mechanical trigger mechanism 40 comprises a solenoid 26 which is in communication with, and controlled by, a processor 28, such as a central processing unit (CPU) and is also connected to a hammer 20 and a trigger 22 via a sear disconnect 24.

A firing mode selector 14 provides an apparatus for switching operation of the firearm 10 between a safe mode, a semi-automatic mode, and an automatic mode as determined, or required, by a user of the firearm 10.

The solenoid 26 is also connected to a plunger 32 which extends between the solenoid 26 and the sear disconnect 24. In one embodiment, the solenoid plunger 32 can be biased towards the sear disconnect 24 by a coil spring or an elastic member.

The hammer 20 includes a primary sear abutment 56 and a secondary sear abutment 54, and is pivotally mounted by a transversely oriented pivot pin 35.

The sear disconnect 24 includes a secondary sear 46 and is moveable between a catch position and a release position. In the catch position the secondary sear 46 engages the secondary sear abutment 54 and the hammer 20 is held in a cocked position. In the release position the secondary sear 46 is pivoted such that the secondary sear 46 disengages the secondary sear abutment 54 so that the hammer 20 is not retained by the secondary sear 46.

The sear disconnect 24 further includes a slotted opening 42 operative with pin 44 connected to the solenoid plunger 32. This configuration connects the sear disconnect 24 and the solenoid 26. In use, this configuration allows the solenoid 26 to engage the sear disconnect 24, thus releasing it from the secondary sear 46 and allowing for automatic firing, when necessary.

The CPU 28 is operatively connected to a power source, in the form of a battery 48, a trigger sensor 50 which is used for sensing whether or not the trigger 22 is pulled, a firing mode sensor 52 which is used for sensing the position of the firing mode selector 14 and a timer 55 which is used to determine the rate of fire by the firearm 10. It will be understood that the location of the CPU 28, the battery 48, the trigger sensor 50, the firing mode sensor 52 and the timer 55 may be anywhere within the firearm 10 and not simply at the locations outlined in FIG. 1. In operation, the CPU 28 controls the supply of current from the battery 48 to the solenoid 26, and includes circuitry or software instructions to apply a current pulse to the solenoid 26 for a pre-determined number of times, corresponding to a number of rounds to be fired to provide a burst fire mode. This is based on inputs which are received by the processor 28 from the various sensors located throughout the firearm 10. Furthermore, a temperature sensor 58 is located within a barrel 57 of the firearm to provide temperature information to the CPU 28 so that the CPU can control the solenoid 26 based on this information. In alternative embodiments, the CPU 28 can receive other information which can assist in controlling the solenoid 26. This other information can be in the form of a user input or could be information which is received from a firearm sighting system.

In semi-automatic operation of the firearm, the firing mode selector 14 is set to semi-automatic and the electro-mechanical trigger mechanism 40 operates in a purely mechanical manner whereby the solenoid 26 is not used. In this situation, the CPU 28 may not be fully powered in order to conserve the battery 48. When the firing mode sensor 52 transmits a signal to the processor that the semi-automatic mode has been selected, the processor does not allow current to be supplied to the solenoid 26.

In order to initiate the semi-automatic firing mode, the hammer 20 is cocked either from a previous use or through the user physically pulling back the bolt (not shown). The hammer 20 is held by the engagement between the primary sear abutment 56 and the primary sear 36.

When the trigger 22 is pulled, the hammer 20 is released, and engages a firing pin (not shown) to fire a round from the firearm and to cock the hammer 20, which is caught and held by the engagement of the secondary sear abutment 54 and the secondary sear 46.

When the trigger 22 is released, the secondary sear 46 is released, but the hammer 20 remains cocked by the engagement of the primary sear abutment 36 and the primary sear 56 and this completes one cycle of ammunition firing in the semi-automatic firing mode.

In automatic firing mode operation of the firearm, the firing mode selector 14 is set to automatic and the electro-mechanical trigger mechanism 10 operates in an electro-mechanical manner. The CPU 28 may be activated by the firing mode sensor 52 which transmits a signal to the CPU 28 indicating that the firing mode selector 14 has been set to automatic and the CPU 28 provides current to the solenoid 26 to control the firing of the firearm.

In order to initiate the automatic firing mode, the hammer 20 is cocked either from previous use or by physically pulling back the bolt to cock the hammer 20. The hammer 20 is held by the engagement of the primary sear abutment 56 and the primary sear 36.

When the trigger 22 is pulled, the hammer 20 is released, and engages a firing pin to fire a round from the firearm and cock the hammer 20, which is caught and held by the engagement of the secondary sear abutment 54 and the secondary sear 46.

However, unlike semi-automatic mode, if the firing mode selector 14 is set to automatic and the trigger 22 is held in place, the CPU 28 provides current to cycle the solenoid 26 in accordance with a selected control methodology. Therefore, the CPU continues to control the necessary current to the solenoid 26 so that the firearm can continue to operate in the automatic firing mode. The trigger sensor 50 detects whether the trigger is pulled or released and provides that information to the CPU 28 so that the CPU recognizes that the solenoid 26 is to continually receive current to assist in controlling the firing rate of the firearm in that the CPU can control the flow of current to the solenoid 26 which directly affects the firing rate, or rate of fire In one embodiment, the control methodology may include setting or limiting a rate of fire based on signals received from the timer 55, the barrel temperature sensor 58 or both. As long as the trigger 22 (detected by the trigger sensor 50) is held in place, the CPU 28 will operate the solenoid 26 to trip the sear disconnect 24 causing the secondary sear 46 to release the hammer 20, and continuously engage the firing pin to fire a round from the firearm and re-cock the hammer 20. The hammer 20 is caught and held by the engagement of the secondary sear abutment 54 and the secondary sear 46, until the solenoid 26 cycles or the trigger 22 is released. If the trigger 22 remains held, the solenoid 26 cycles again allowing another round to be fired.

When the trigger 22 is released, the hammer 20 is caught by the engagement of the primary sear abutment 56 and the primary sear 36 and held in the cocked position, and this competes one cycle of operation in automatic mode. In one embodiment, once the trigger sensor senses release of the trigger, a signal is transmitted to the processor to stop the flow of current to deactivate the solenoid.

Figure 2:
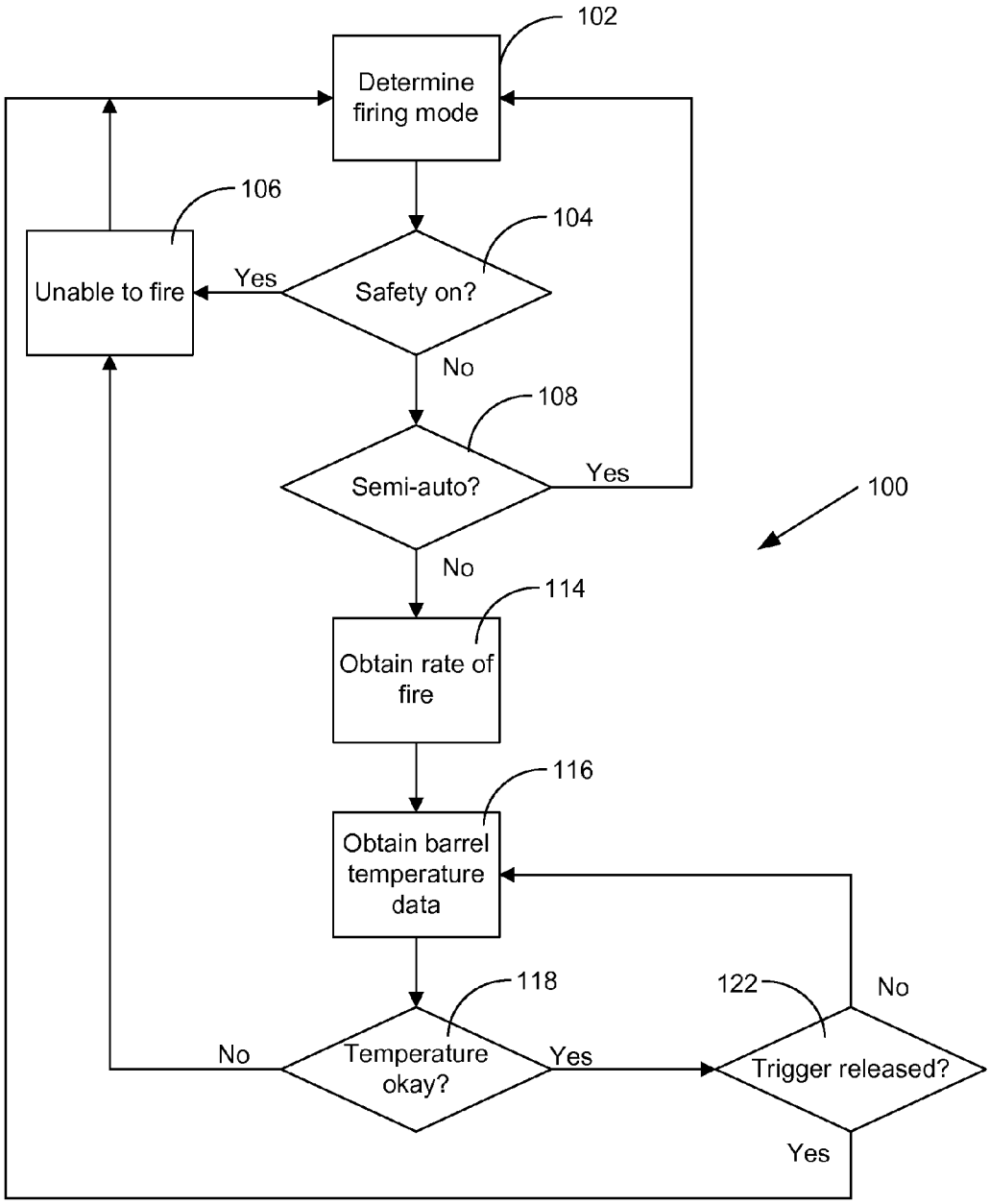
FIG. 2 is a flow chart of a method of using an electro-mechanical trigger mechanism for controlling a firearm.

Referring now to FIG. 2 a flow chart of a method for use of an electro-mechanical trigger mechanism in controlling a firearm is shown generally as 100. Although this is shown as a sequential process, one skilled in the art will recognize that many of the steps may run in parallel and interrupt the stream to provide data, examples being at steps 114, 116 and 120.

Beginning at step 102, a test is made by the processor 28 to determine the position or status of the firing mode selector 14. In one embodiment, this can be performed by having the processor 28 communicating with or accessing the firing mode sensor 52 to retrieve the mode selector information. At step 104, a test is made to determine if the safety of the firearm is on or if the firing mode selector has been set to safe mode. If the safety is on or the firing mode selector 14 is set to safe mode, the firearm is unable to fire (step 106) and processing returns back to step 102 to monitor the firing mode selected by the firing mode selector. At step 108, a test is made to determine if the firing mode selector is set at semi-automatic by having the processor communicate with the firing mode sensor. If so the firearm is considered active and may operate in semi-automatic mode until the status or position of the selector 14 is changed. This is continually checked in step 102. Should the test at step 108 indicate that the firearm is not semi-automatic, then it is fully automatic as can be confirmed by the processor and processing moves to step 114. As discussed above, the processor continually checks the firing mode sensor to determine the selected firing mode. At step 114 a test is made to determine or control the rate of fire. In one embodiment, the CPU 28 obtains data from timer 55 which provides data on how quickly the firearm is discharging rounds. Processing then moves to step 116 where the barrel temperature is tested by barrel temperature sensor 58. The barrel temperature is then transmitted to the processor so that the processor can further control the rate of fire, if necessary. At step 118, if the barrel temperature is within an acceptable range for the firearm, processing moves to step 122 where a test is made to determine if the trigger 22 has been released by having the processor communicate with the trigger sensor, otherwise the firearm can continue to be used in automatic mode and the temperature of the barrel continued to be monitored (step 116). If the temperature is determined to be too hot, in one embodiment, the CPU can lower the rate of fire to reduce the amount of heat generated by controlling the current flow being supplied to the solenoid. In another embodiment, a signal may be transmitted from the CPU processor to the solenoid to power down the solenoid so that the firearm returns to the release position and therefore no longer in the automatic firing mode. At step 122, if the trigger has been released, processing returns to step 102 until the firearm is be used again.

While in automatic firing mode, steps 116, 118 and 122 can be cycled to determine if automatic firing should be disabled or the rate of fire reduced due to temperature (step 118) or by the release of the trigger (step 122).

In the preceding description, for purposes of explanation, numerous details are set forth in order to provide a thorough understanding of the embodiments of the invention. However, it will be apparent to one skilled in the art that these specific details are not required in order to practice the invention. In other instances, well-known electrical structures and circuits are shown in block diagram form in order not to obscure the invention.

The above-described embodiments of the invention are intended to be examples only. Alterations, modifications and variations can be effected to the particular embodiments by those of skill in the art without departing from the scope of the invention, which is defined solely by the claims appended hereto.

What is claimed is:

1. An electro-mechanical trigger mechanism for controlling automatic firing of a firearm, the electro mechanical trigger mechanism comprising:

a firing mode selector for placing the firearm in an automatic firing mode and a semi-automatic firing mode;

a solenoid operatively connected to a sear disconnect of the firearm;

a processor operatively coupled to the solenoid, wherein the processor actuates the solenoid when a trigger of the electro-mechanical trigger mechanism is actuated and the firearm is in the automatic firing mode; and wherein the solenoid is not actuated when the trigger of the electro-mechanical trigger mechanism is actuated and the firearm is in the semi-automatic firing mode.

2. The electro-mechanical trigger mechanism of claim 1 wherein the solenoid further comprises a solenoid plunger extending between the solenoid and the sear disconnect.

3. The electro-mechanical trigger mechanism of claim 2 further comprising: a power source connected to the solenoid.

4. The electro-mechanical trigger mechanism of claim 1 further comprising: a firing mode selector sensor for monitoring a firing mode selected by the firing mode selector; wherein the firing mode selector sensor is in communication with the processor to indicate when the firearm is in an automatic firing mode.

5. The electro-mechanical trigger mechanism of claim 4 further comprising: a timer for monitoring the rate of fire of the firearm, the timer in communication with the processor.

6. The electro-mechanical trigger mechanism of claim 1 further comprising: a barrel temperature sensor; wherein the barrel temperature sensor is in communication with the processor to transmit a barrel temperature such that if the barrel temperature is greater than a predetermined value, the processor increases the cycle time of the solenoid to reduce a rate of fire.

7. The electro-mechanical trigger mechanism of claim 1, further comprising a sensor configured to detect the position of the trigger, wherein the sensor is operatively coupled to the processor.

8. The electro-mechanical trigger mechanism of claim 1, further comprising a sensor configured to detect whether the firearm is in either the automatic or the semi-automatic firing mode, wherein the sensor is operatively coupled to the processor.

9. The electro-mechanical trigger mechanism of claim 1, further comprising a temperature sensor configured to detect a temperature of a barrel of the firearm, wherein the temperature sensor is operatively coupled to the processor.

10. The electro-mechanical trigger mechanism of claim 1, further comprising a trigger sensor configured to detect the position of the trigger, wherein the trigger sensor is operatively coupled to the processor;

a firing mode sensor configured to detect whether the firearm is in either the automatic or the semi-automatic firing mode, wherein the firing mode sensor is operatively coupled to the processor; and a temperature sensor configured to detect a temperature of a barrel of the firearm, wherein the temperature sensor is operatively coupled to the processor.

11. The electro-mechanical trigger mechanism of claim 10, further comprising a timer, wherein the timer is operatively coupled to the processor.

12. The electro-mechanical trigger mechanism of claim 1, further comprising a timer, wherein the timer is operatively coupled to the processor.

13. The electro-mechanical trigger mechanism of claim 1, wherein the processor is configured to provide a predetermined number of current pules to the solenoid when the trigger is depressed and the firearm is in an automatic firing mode.

14. An electro-mechanical trigger mechanism for a firearm, the electro mechanical trigger mechanism being capable of operating in an automatic firing mode and a semi-automatic firing mode; a firing mode selector for placing the firearm in the automatic firing mode and the semi-automatic firing mode; a solenoid for use only in the automatic firing mode, the solenoid being operatively connected to a sear disconnect of the firearm; a processor operatively coupled to the solenoid, wherein the processor actuates the solenoid when a trigger of the electro-mechanical trigger mechanism is actuated and the firearm is in the automatic firing mode; and wherein the solenoid is not actuated when the trigger of the electro-mechanical trigger mechanism is actuated and the firearm is in the semi-automatic firing mode.

15. The electro-mechanical trigger mechanism of claim 14, further comprising a sensor configured to detect the position of the trigger, wherein the sensor is operatively coupled to the processor.

16. The electro-mechanical trigger mechanism of claim 14, further comprising a sensor configured to detect whether the firearm is in either the automatic or the semi-automatic firing mode, wherein the sensor is operatively coupled to the processor.

17. The electro-mechanical trigger mechanism of claim 14, further comprising a temperature sensor configured to detect a temperature of a barrel of the firearm, wherein the temperature sensor is operatively coupled to the processor.

18. The electro-mechanical trigger mechanism of claim 14, further comprising a trigger sensor configured to detect the position of the trigger, wherein the trigger sensor is operatively coupled to the processor;

a firing mode sensor configured to detect whether the firearm is in either the automatic or the semi-automatic firing mode, wherein the firing mode sensor is operatively coupled to the processor; and a temperature sensor configured to detect a temperature of a barrel of the firearm, wherein the temperature sensor is operatively coupled to the processor.

19. The electro-mechanical trigger mechanism of claim 18, further comprising a timer, wherein the timer is operatively coupled to the processor.

20. The electro-mechanical trigger mechanism of claim 14, further comprising a timer, wherein the timer is operatively coupled to the processor.

21. The electro-mechanical trigger mechanism of claim 14, wherein the processor is configured to provide a predetermined number of current pules to the solenoid when the trigger is depressed and the firearm is in an automatic firing mode.

* * * * *